US005368186A

United States Patent [19]

Yeh

[11] Patent Number: 5,368,186

[45] Date of Patent: Nov. 29, 1994

[54] SAFETY LID FOR DRINKING MUG

[76] Inventor: Frank Yeh, 1019 N. Mayflower St., Anaheim, Calif. 92801

[21] Appl. No.: 148,936

[22] Filed: Nov. 8, 1993

[51] Int. Cl.[5] ..... B65D 39/00

[52] U.S. Cl. ..... 220/713; 220/710.5; 220/358; 222/571

[58] Field of Search ..... 220/352, 356, 357, 358, 220/710.5, 713; 222/569, 571

[56] References Cited

U.S. PATENT DOCUMENTS

| | | | |
|---|---|---|---|
| 2,197,766 | 4/1940 | Mueller | 221/571 |
| 2,243,636 | 5/1941 | Kraetch | 222/569 |
| 2,437,784 | 9/1944 | Laskin . | |
| 2,707,574 | 5/1955 | Klebenow | 222/571 |
| 3,105,621 | 10/1963 | Francis | 222/571 |
| 3,140,799 | 7/1964 | Mehr . | |
| 3,915,355 | 10/1975 | Young | 220/356 |
| 4,243,156 | 1/1981 | Lobbestael . | |
| 4,303,170 | 12/1981 | Panicci . | |
| 4,582,218 | 4/1986 | Ross . | |
| 4,858,787 | 8/1989 | Stone | 222/569 |
| 4,986,437 | 1/1991 | Farmer . | |
| 5,018,636 | 5/1991 | Ross . | |
| 5,102,000 | 7/1992 | Feltman, III . | |
| 5,143,248 | 9/1992 | Sawatsky | 220/713 |
| 5,150,803 | 9/1992 | Cartellone . | |
| 5,217,141 | 6/1993 | Ross . | |
| 5,249,703 | 10/1993 | Karp . | |

*Primary Examiner*—David T. Fidei
*Attorney, Agent, or Firm*—Raymond Sun

[57] ABSTRACT

A safety lid adapted for use with a mug, the mug having a circumferential mouth and an internal surface. The safety lid comprises a disk and a central core attached to the bottom surface of the disk. The central core has a circular side wall. The safety lid further comprises a circular sealing ring having an inner surface attached to the circular side wall of the central core and an outer surface adapted to frictionally engage the internal surface of the mouth of the mug.

9 Claims, 2 Drawing Sheets

SAFETY LID FOR DRINKING MUG

BACKGROUND OF THE INVENTION

1. Field of the Invention

The present invention relates to a safety lid for use with conventional mugs or beverage containers. In particular, the present invention relates to a safety lid provided with a sealing means which securely retains the lid at the mouth of the mug or beverage container to prevent spillage of the liquid contained therein.

2. Description of the Related Art

The present invention is applicable to mugs and beverage containers alike, which shall hereinafter be collectively referred to as "mugs". The present invention shall also be described hereinbelow in connection with a conventional mug, although it will be appreciated that the principles of the present invention are also applicable to all conventional beverage containers.

There are many safety lids that are provided for use with mugs. These safety lids perform two primary functions: (1) to cover the open mouth of the mug to prevent the liquid contained in the mug from spilling, and (2) to maintain the temperature of hot liquid in the mug by preventing the escape of steam. It is expected that such safety lids be provided at low cost to the public.

Many of the currently-available safety lids suffer from a number of drawbacks, the most serious being that these lids are not securely retained at the mouth of the mug, which allows spillage of the liquid if the mug is tipped over. These lids also make it inconvenient for a user to drink from the mug, since an insecure lid usually means that the user must hold the lid while drinking.

Several attempts have been made to remedy this drawback. For example, snap-fit lids were provided, but they are unreliable since they must be entirely snapped in place to be effective.

Another example is U.S. Pat. No. 4,582,218 to Ross, which discloses a mug 10 which is specifically provided with a recessed shelf 30 extending inwardly from the internal wall 20 of the mug 10. Gaps 32 are provided in the shelf 30. A lid 40 is provided with tongues 48 and 50, which are adapted to be inserted through the gaps 32. The lid 40 is then rotated about the shelf 30 to secure the lid 40 to the mouth of the mug 10.

As a further example, U.S. Pat. No. 5,018,636 to Ross also discloses a mug 10 with a recessed shelf 30. However, the lid 40 is provided with a pair of retaining means 60 and 70, in the form of a flexible elongated rod 62 or 72 extending from the lower surface 46 of the lid 40 and having a spherical ball 64 or 66 provided at the end of the rod 62. In use, the lid 40 may be inserted into the mug 10 such that the lower surface 46 of the lid 40 rests on the upper portion 31 of the recess 30, with the flexible rods 62 and 72 bent inwardly, and the balls 64 and 66 resting adjacent the lower portion 38 of the recess 30.

Yet another example is U.S. Pat. No. 5,102,000 to Feltman, III, which discloses a mug 11 having an inwardly projecting ring 16 with vertical passages 17 and latch notches 18 formed in the ring 16. The lid 15 has a pair of flexible fingers 30, each having a rounded end 29. In use, the lid 15 is inserted into the mouth of the mug 11 such that the rounded ends 29 pass through the vertical passages 17. The lid 15 is then rotated so that the rounded ends 29 are fitted in the latch notches 18 to provide a secure fit.

While each of the above-described mug and lid combinations provide a somewhat secure fit of the lid to the mouth of the mug, they suffer from other drawbacks. The primary drawback is that, in each of the Ross '218, Ross '636 and Feltman devices, a specific mug and lid combination must be provided. Therefore, each of these mugs must be used with its intended lid. In fact, none these lids can be adapted for use with conventional mugs since conventional mugs do not have the required internal ring or shelf having passages or notches formed therein.

Additionally, these structural features often make the mug look aesthetically unappealing and cumbersome because they add a number of components that are not ordinarily provided on conventional mugs. Some of these lids require that the mug include an unsightly neck portion. The use of these lids is also complicated in that much manipulation, twisting and turning is needed to secure the lid in place. These lids are also ineffective if not properly secured.

Thus, there is a need for a safety lid that may be adapted for use with any conventional mug, is easy to use, can be provided at low cost, and which effectively secures the lid to the mouth of the mug to prevent spillage.

SUMMARY OF THE INVENTION

The objects of the present invention may be achieved by providing a safety lid adapted for use with a mug, the mug having a circumferential mouth and an internal surface. The safety lid comprises a disk and a central core attached to the bottom surface of the disk, the disk having a diameter greater than the diameter of the central core. The central core has a circular side wall. The safety lid further comprises a circular sealing ring having an inner surface attached to the circular side wall of the central core and an outer surface adapted to frictionally engage the internal surface of the mouth of the mug.

In a first preferred embodiment of the present invention, the sealing ring is made of a resilient and flexible non-toxic material such as rubber, silicon, or polyethylene. In a second preferred embodiment, instead of the sealing ring, a plurality of strips of sealing material made from the same material as the sealing ring may be attached to the side wall of the central core.

The safety lid according to the present invention further comprises a semi-circular gap provided along the circumferential edge of the disk. The central core further comprises a curved channel having a semi-circular shape, with the sealing ring having a curved segment adapted to be fitted to the side wall of the central core at the location of the curved channel. The curved channel is aligned with the semi-circular gap of the disk to allow liquid to pass through the channel and the gap.

Therefore, the safety lid according to the present invention provides a lid which is effectively retained at the mouth of the mug. The lid is also easy to manufacture, can be provided at low cost, and is easy to use. Furthermore, the lid can be adapted for use with any conventional mug having almost any shape, and regardless of whether the mug has any neck.

DESCRIPTION OF THE PREFERRED EMBODIMENTS

The following detailed description is of the best presently contemplated modes of carrying out the invention. This description is not to be taken in a limiting sense, but is made merely for the purpose of illustrating general principles of embodiments of the invention. The scope of the invention is best defined by the appended claims.

Figure 1:
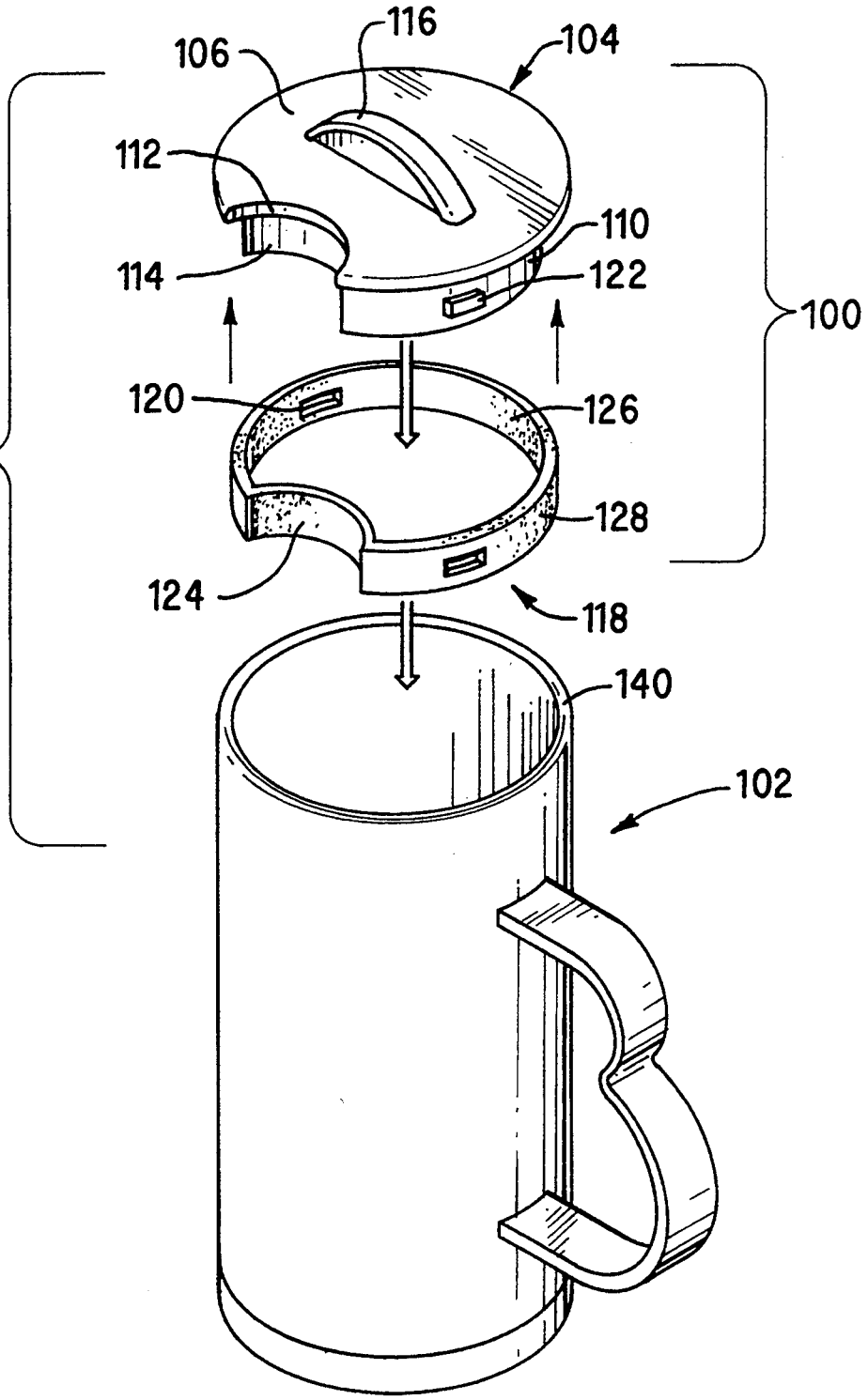
FIG. 1 is an exploded perspective view of a first embodiment of the safety lid in accordance with an exemplary embodiment of the present invention shown adapted for use with a conventional mug.

The safety lid 100 in accordance with a first preferred embodiment of the present invention is shown in FIG. 1 adapted for use with a conventional mug 102. The lid 100 comprises a disk 104 having a top surface 106, a bottom surface 108, and a central core 109 having a circular side wall 110. As shown in FIG. 1, the disk 104 has a greater diameter than the diameter of the central core 109. The core 109 may be integrally formed with the disk 104 or may be a separate component attached to the disk 104 by any conventional means. A semi-circular gap 112 is provided along the circumferential edge of the disk 104. Although only one gap 112 is shown in FIG. 1, it is possible for more than one gap to be provided; however, it must be remembered that more gaps may provide more openings through which the liquid in the mug 102 may spill from. The depth of the gap 112 in the disk 104 extends inwardly to a distance adjacent the side wall 110. To allow the liquid in the mug 102 to flow out of the mug 102 through the lid 100, the vertical area of the side wall 110 in alignment with the gap 112 contains a recess or channel 114. Although the gap 112 and the channel 114 are shown as being curved in configuration, they can also be provided in other configurations without departing from the spirit and scope of the present invention. A handle 116 is formed on the upper surface 106.

The safety lid 100 of the present invention further comprises a sealing ring 118 made from a flexible and resilient non-toxic material; for example, rubber, silicon, or polyethylene. As shown in FIG. 1, the sealing ring 118 has an internal surface 126 and an external surface 128, and is sized and configured to be slipped over the central core 109 such that the internal surface 126 frictionally engages the outer surfaces of the side wall 110 of the lid 100 to form a tight fit thereto. For example, as shown in FIG. 1, the sealing ring 118 is also provided with a curved section 124 which is adapted to correspond to the curved surface of the channel 114. The resiliency of the material used for the sealing ring 118 ensures the required tight fit. Alternatively, the sealing ring 118 can be adhered to the outer surface of the side wall 110 by any conventional non-toxic adhesive. Yet another method of securing the sealing ring 118 to the side wall 110 is to provide two or more tongues 120 to the internal surface 126 of the sealing ring 118 for engaging openings 122 provided in the side wall 110. Yet a further method is to provide a plurality of openings (not shown) in the sealing ring 118 which are adapted to engage corresponding projections (not shown) extending from the side wall 110.

Figure 2:
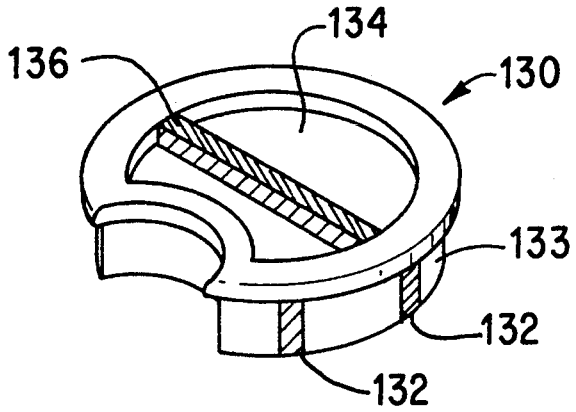
FIG. 2 is a perspective view of a second embodiment of the safety lid of the present invention.

According to a second preferred embodiment of the safety lid 130 shown in FIG. 2, instead of a sealing ring 118, strips 132 of sealing material may be attached to the side wall. 133 of the central core 109. The number of strips 132 used can be varied as desired, but it is preferred that at least three such strips 132 be used to provide sufficient sealing strength. The strips 132 are preferably made from the same material as sealing ring 118, and may be attached by the attachment methods described above for the sealing ring 118.

The safety lid 100 is preferably made from a non-toxic material such as polypropylene, polyethylene, wood, ceramics, or glass. It will be appreciated by those skilled in the art that the interior of the lid 100 can also be made hollow, such as shown in the second embodiment of FIG. 2, where a hollow bevel 134 is provided. It will also be appreciated by those skilled in the art that the choice and design of the handle 116 can be varied without departing from the spirit and scope of the present invention. For example, as shown in FIG. 2, the handle 136 can be formed as a ridge in the hollow interior of the lid 130.

Figure 3:
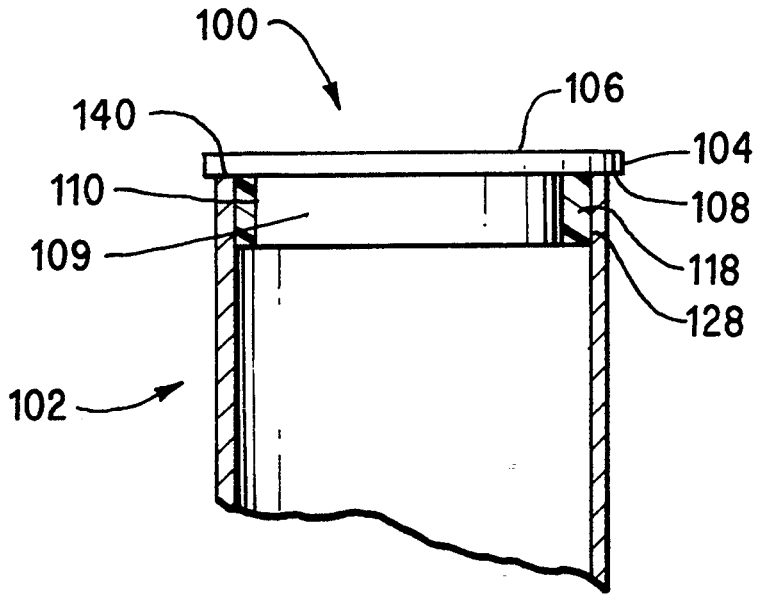
FIG. 3 is a partial cross-sectional view of the lid of FIG. 1 sealing the mouth of the mug of FIG. 1.
Figure 1:
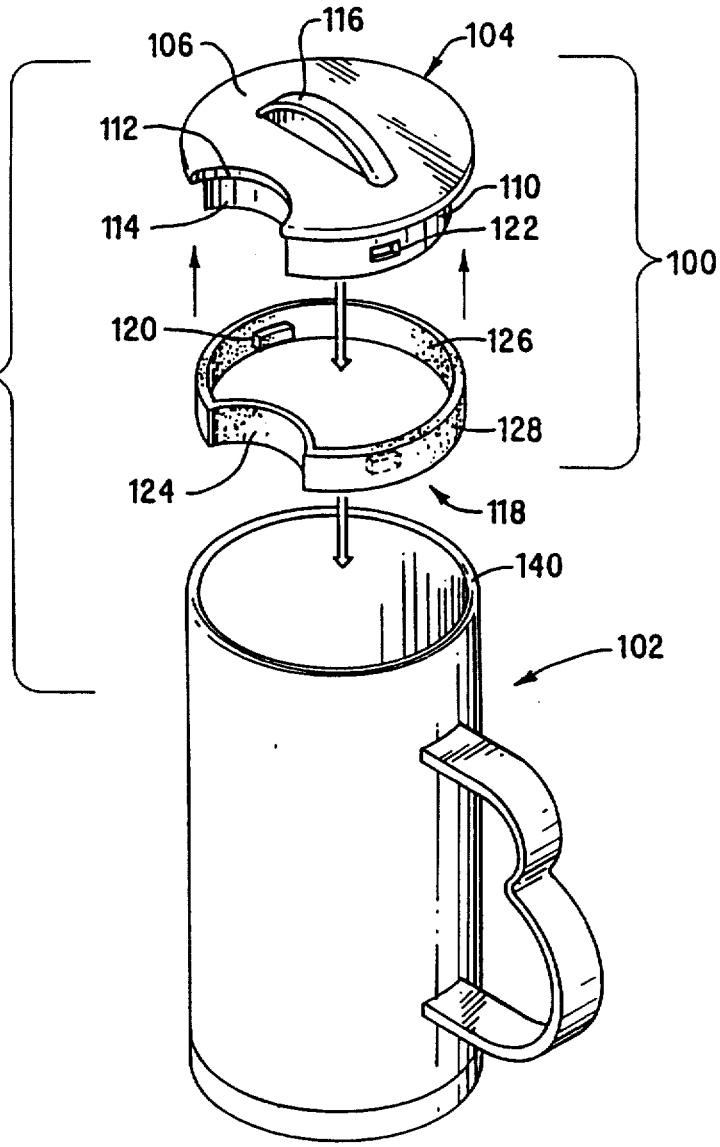

Referring to FIG. 3, when in use, the safety lid 100 of FIG. 1 can be inserted into the mouth of any conventional mug 102. When so inserted, the side wall 110 and sealing ring 118 are snugly fitted in the mouth of the mug 102. The external surface 128 of the sealing ring 118 frictionally engages the inner surface of the mug 102 for securely retaining the lid 100 in place at the mouth of the mug 102. Furthermore, disk 104 overlies the mouth of the mug 102 in a manner that the bottom surface 108 impinges against the upper circumferential edge 140 of the mouth of the mug 102, thereby defining the limit by which the lid 100 can be inserted into the mug 102. Therefore, the escape of steam from the mug 102 is prevented by both the snug fit of the sealing ring 118 and the disk 104 completely covering the mouth of the mug 102. When an individual wishes to drink liquid from the mug 102 with the lid 100 in place, he or she merely tilts the mug 102 and the liquid flows through the channel 114 and the gap 112 into his or her mouth. The secure fit of the lid 100 to the mouth of the mug 102 makes it unnecessary for the individual to hold the lid 100 when tilting the mug 102.

Therefore, the safety lid 100 of the present invention provides a lid which is effectively retained at the mouth of the mug 102. Because of its simple design and construction, the lid 100 is also easy to manufacture and easy to use. Also, the materials used to fabricate the lid 100 are inexpensive, so that the lid 100 can be provided at low cost to the public. Furthermore, the lid 100 can be adapted for use with any conventional mug having almost any shape, and regardless cf whether the mug has any neck. As for the size of the lid 100, the lid 100 can be made in varying sizes to fit the normal sizes of the mouths of conventional mugs.

While the description above refers to particular embodiments of the present invention, it will be understood that many modifications may be made without departing from the spirit thereof.

What is claimed is:

1. A safety lid for use with a mug, the mug including a circumferential mouth having an internal surface, the safety lid comprising:

a disk having an upper surface, a bottom surface, a circumferential edge, and a semi-circular gap provided along the circumferential edge;

a central core attached to the bottom surface of the disk, the central core having a circular side wall and a curved channel having a semi-circular shape; and a flexible sealing ring having an outer surface and an inner surface, the inner surface of the sealing ring attached to the circular side wall and the outer surface of the sealing ring adapted to frictionally engage the internal surface of the mouth of the mug;

wherein the flexible sealing ring further comprises a curved segment adapted to be fitted to the circular side wall of the central core at the location of the curved channel, and wherein the curved channel is aligned with the semi-circular gap of the disk.

2. The safety lid of claim 1, wherein the disk has a diameter greater than the diameter of the central core.

3. The safety lid of claim 1, wherein a handle is provided on the upper surface of the disk.

4. The safety lid of claim 1, wherein the sealing ring is made from a material selected from the group consisting of rubber, silicon, and polyethylene.

5. The safety lid of claim 1, wherein the sealing ring has a resiliency which holds the sealing ring tightly against the circular side wall.

6. The safety lid of claim 1, further comprising means for attaching the sealing ring to the circular side wall.

7. The safety lid of claim 6, wherein the attaching means comprises an adhesive applied to attach the inner surface of the sealing ring to the circular side wall.

8. The safety lid of claim 6, wherein the attaching means comprises a plurality of tongues on the inner surface of the sealing ring, and a corresponding plurality of openings provided in the circular side wall for receiving the plurality of tongues.

9. The safety lid of claim 6, wherein the attaching means comprises a plurality of projections extending from the circular side wall, and a corresponding plurality of openings provided in the sealing ring for receiving the plurality of projections.

* * * * *

UNITED STATES PATENT AND TRADEMARK OFFICE

CERTIFICATE OF CORRECTION

PATENT NO. : 5,368,186

DATED : November 29, 1994

INVENTOR(S) : Frank Yeh

It is certified that error appears in the above-identified patent and that said Letters Patent is hereby corrected as shown below:

Title page should be deleted, and substitute therefor the attached title page.

In the Drawings, Figure 1 should be deleted and substitute therefor the attached Figure 1.

Signed and Sealed this

Nineteenth Day of September, 1995

*Attest:*

Bruce Lehman

BRUCE LEHMAN

*Attesting Officer*

*Commissioner of Patents and Trademarks*

US005368186A

United States Patent [19]

Yeh

[11] Patent Number: 5,368,186

[45] Date of Patent: Nov. 29, 1994

[54] SAFETY LID FOR DRINKING MUG

[76] Inventor: Frank Yeh, 1019 N. Mayflower St., Anaheim, Calif. 92801

[21] Appl. No.: 148,936

[22] Filed: Nov. 8, 1993

[51] Int. Cl.[5] ..... B65D 39/00

[52] U.S. Cl. ..... 220/713; 220/710.5; 220/358; 222/571

[58] Field of Search ..... 220/352, 356, 357, 358, 220/710.5, 713; 222/569, 571

[56] References Cited

U.S. PATENT DOCUMENTS

| | | | |
|---|---|---|---|
| 2,197,766 | 4/1940 | Mueller | 221/571 |
| 2,243,636 | 5/1941 | Kraetch | 222/569 |
| 2,437,784 | 9/1944 | Laskin . | |
| 2,707,574 | 5/1955 | Klebenow | 222/571 |
| 3,105,621 | 10/1963 | Francis | 222/571 |
| 3,140,799 | 7/1964 | Mehr . | |
| 3,915,355 | 10/1975 | Young | 220/356 |
| 4,243,156 | 1/1981 | Lobbestael . | |
| 4,303,170 | 12/1981 | Panicci . | |
| 4,582,218 | 4/1986 | Ross . | |
| 4,858,787 | 8/1989 | Stone | 222/569 |
| 4,986,437 | 1/1991 | Farmer . | |
| 5,018,636 | 5/1991 | Ross . | |
| 5,102,000 | 7/1992 | Feltman, III . | |
| 5,143,248 | 9/1992 | Sawatsky | 220/713 |
| 5,150,803 | 9/1992 | Cartellone . | |
| 5,217,141 | 6/1993 | Ross . | |
| 5,249,703 | 10/1993 | Karp . | |

*Primary Examiner*—David T. Fidei
*Attorney, Agent, or Firm*—Raymond Sun

[57] ABSTRACT

A safety lid adapted for use with a mug, the mug having a circumferential mouth and an internal surface. The safety lid comprises a disk and a central core attached to the bottom surface of the disk. The central core has a circular side wall. The safety lid further comprises a circular sealing ring having an inner surface attached to the circular side wall of the central core and an outer surface adapted to frictionally engage the internal surface of the mouth of the mug.

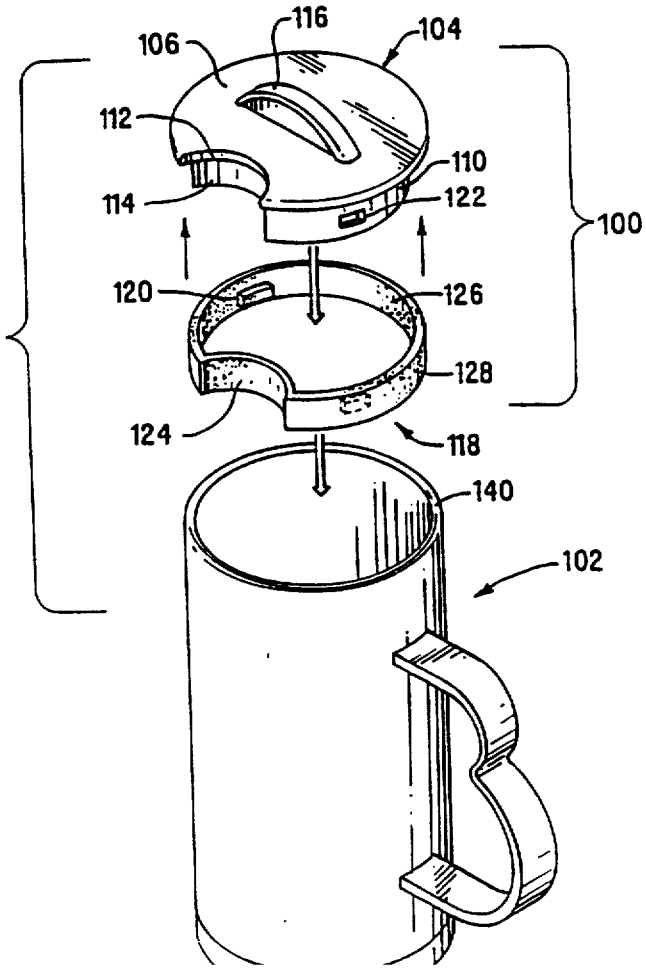

9 Claims, 2 Drawing Sheets